US006145836A

United States Patent [19]

Toulemonde et al.

[11] Patent Number: 6,145,836

[45] Date of Patent: Nov. 14, 2000

[54] LOTTERY BALL SHUFFLING DEVICE AND DRAWING MACHINE EQUIPPED WITH SAID DEVICE

[76] Inventors: Ghislain Toulemonde, 184, rue Jean Jaures, 59170 Croix; Xavier Delgrange, 28 rue de Carvin, 59112 Annoeullin, both of France

[21] Appl. No.: 09/192,442

[22] Filed: Nov. 16, 1998

[30] Foreign Application Priority Data

Nov. 17, 1997 [FR] France ..... 97 14586

[51] Int. Cl.[7] ..... A63B 71/00

[52] U.S. Cl. ..... 273/144 R; 273/144 A; 273/144 B; 273/142 HA

[58] Field of Search ..... 273/144 A, 144 B, 273/144 R, 142 HA

[56] References Cited

U.S. PATENT DOCUMENTS

| | | | |
|---|---|---|---|
| 2,621,042 | 12/1952 | Stein et al. | 272/1 |
| 3,810,629 | 5/1974 | Yamamoto . | |
| 4,813,676 | 3/1989 | Weatherspoon | 273/144 A |
| 4,834,385 | 5/1989 | Jackson | 273/144 A |
| 4,846,476 | 7/1989 | Hanna | 273/144 A |
| 5,419,557 | 5/1995 | Kirland et al. . | |
| 5,743,526 | 4/1998 | Inoue | 273/144 R |

FOREIGN PATENT DOCUMENTS 0 348 281 A1 12/1989 European Pat. Off. .

*Primary Examiner*—Mark S. Graham
*Assistant Examiner*—Dolores Collins
*Attorney, Agent, or Firm*—Miles & Stockbridge P.C.; John C. Kerins

[57] ABSTRACT

A device for shuffling objects such as lottery balls is provided, disposed at the base of a generally spherical enclosure of a lottery machine carrying separately identifiable objects, the shuffling device including first and second concentric rotating parts which together form a substantially contiguous support surface for the objects, and the surfaces of which carry substantially radial slender projecting elements which, in operation, are intended to hit the objects, and also including a driver for rotating the first and second parts at speeds which differ in terms of value and/or direction.

9 Claims, 4 Drawing Sheets

LOTTERY BALL SHUFFLING DEVICE AND DRAWING MACHINE EQUIPPED WITH SAID DEVICE

BACKGROUND OF THE INVENTION

1. Field of the Invention

The invention relates to a device for shuffling objects such as lottery balls.

It also relates to the drawing machine equipped with the shuffling device.

2. Description of Related Art

Drawings for the lottery or similar games generally take place with the aid of balls placed inside a drawing machine.

Instead of balls, disks, dice or cards may be used.

The machine comprises:

an enclosure, generally spherical and transparent, into which is inserted a predetermined number of balls, each having a means of identification, such as a number, different from that of the other balls, and a means for randomly selecting at least one ball, and more generally a predetermined number of balls.

The inserted balls must, of course, be shuffled before the selection of the first ball, and more generally before each selection.

For this purpose, various shuffling devices exist.

For example, there are known devices that use air jets (EP-A-0348281).

These devices are visually attractive but require the balls to be relatively light and/or the air jets to be relatively strong.

There are also known mechanical shuffling devices (U.S. Pat. No. 3,810,629) which use, at the base of the enclosure, a rotating disk whose surface facing the inside of the sphere carries substantially radial projecting bars, which are intended to hit the balls.

The latter devices are easier to produce but could be improved.

Thus, the object of the invention is to improve the mechanical shuffling devices of the type mentioned above.

SUMMARY OF THE INVENTION

To this end, the subject of the invention is a mechanical shuffling device disposed at the base of a generally spherical enclosure of a lottery machine into which are inserted objects, each having a means of identification, this shuffling device comprising a rotating part whose surface facing the inside of the sphere carries slender projecting elements such as substantially radial bars intended to hit the objects, this device being characterized in that the device comprises at least two concentric rotating parts, each equipped with slender projecting elements and means for driving these rotating parts at different speeds.

Another subject of the invention is the lottery machine equipped with the shuffling device according to the invention.

BRIEF DESCRIPTION OF THE DRAWINGS

The invention will be clearly understood with the aid of the description below, given as a non-limiting example in reference to the appended drawing, which represents.

DETAILED DESCRIPTION OF THE PREFERRED EMBODIMENTS

Figure 1:
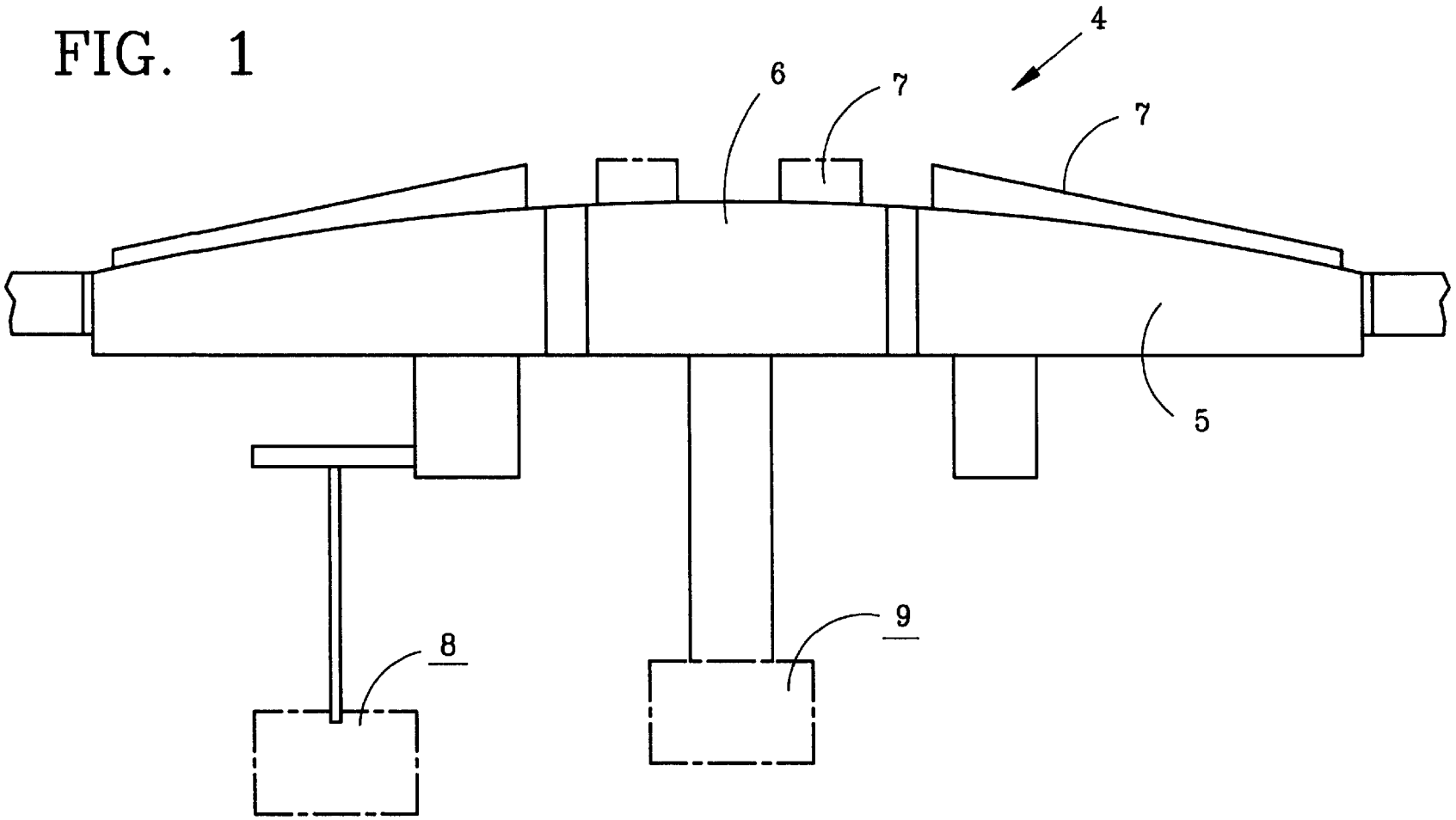
FIG. 1 is a vertical section of a device according to the invention.
Figure 2:
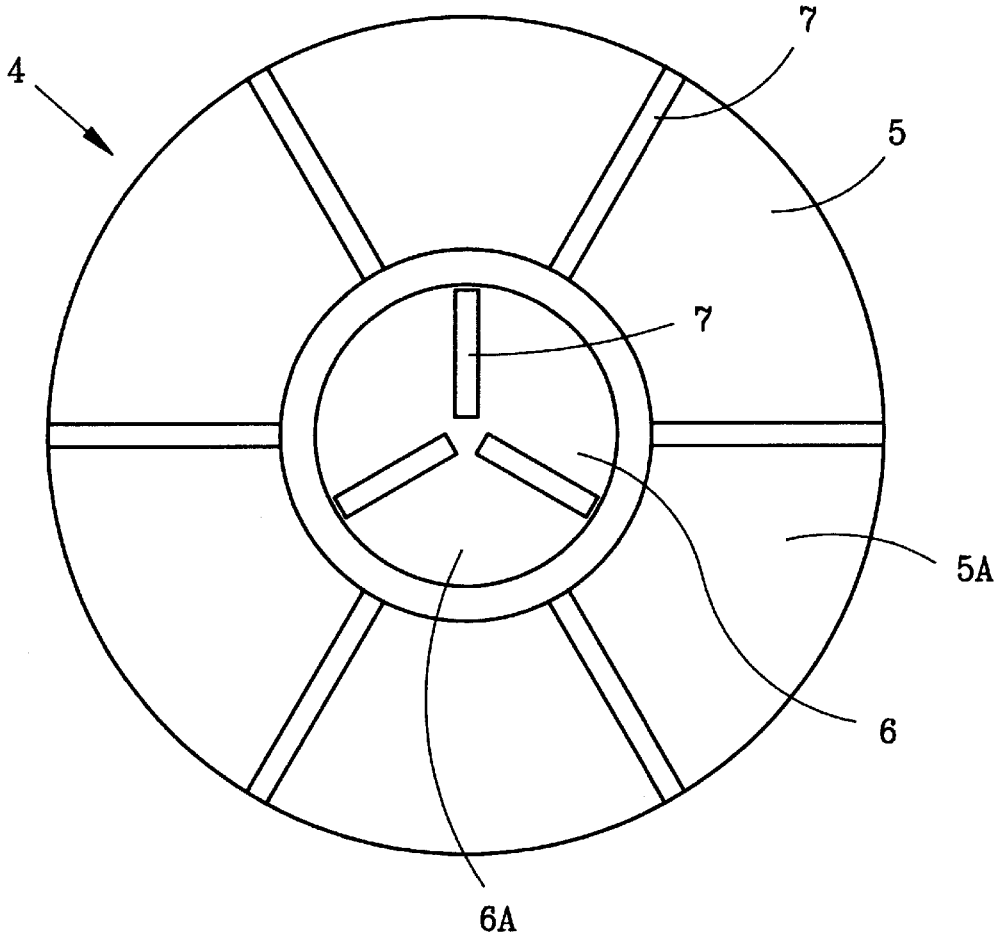
FIG. 2 is a top view of a device according to the invention.
Figure 3:
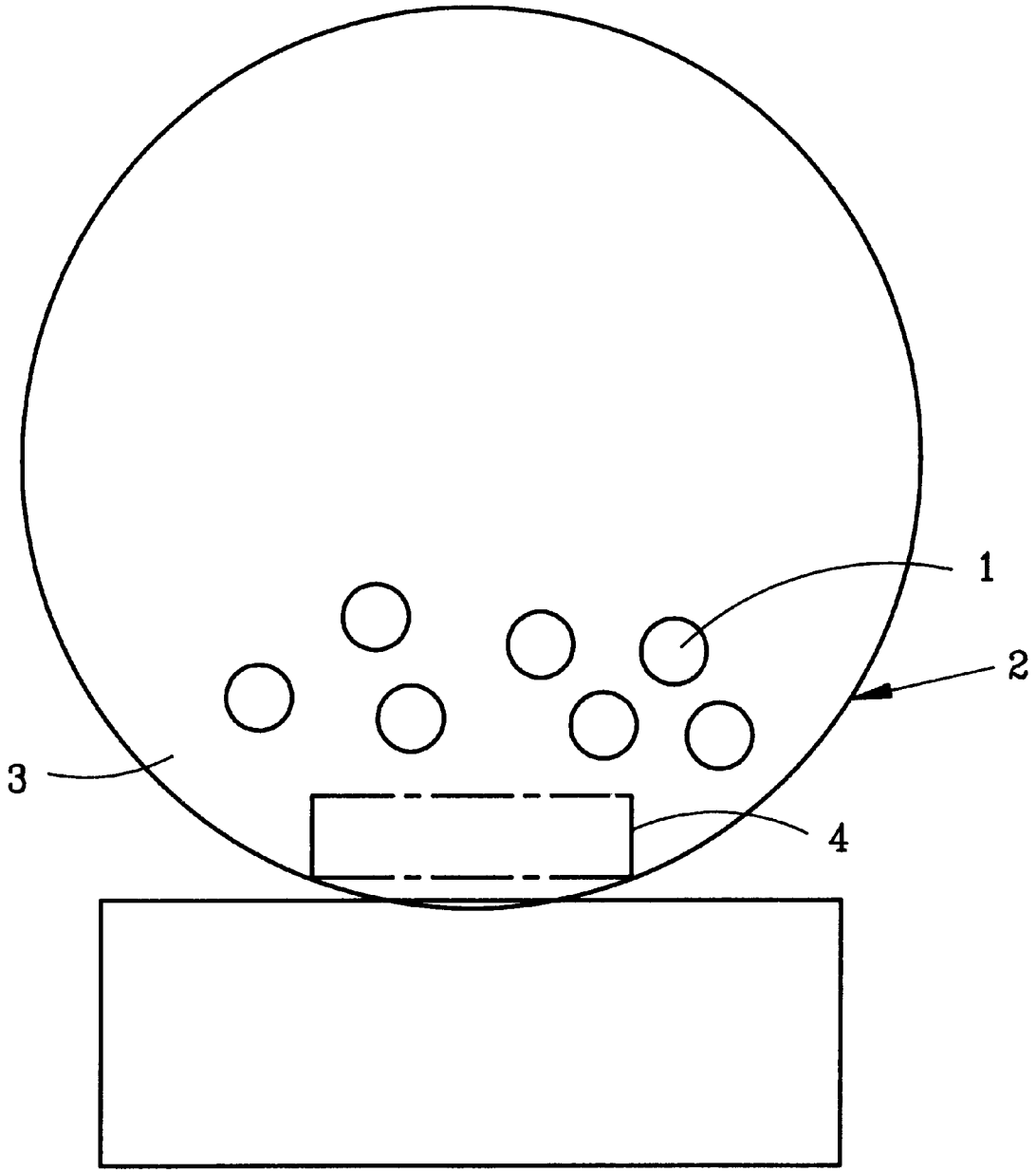
FIG. 3 is a schematic view of a lottery machine.

Referring to the drawing, it may be seen that in order to conduct a lottery, objects such as lottery balls 1 placed in a lottery machine 2 are used.

The latter comprises:

an enclosure 3, generally spherical and transparent, into which is inserted a predetermined number of objects 1 such as balls 1, each having a means of identification, such as a number, different from that of the other balls, or even a geometric figure, and a means for randomly selecting at least one ball, and more generally a predetermined number of balls.

This machine also comprises a shuffling device 4 disposed at the base of the spherical enclosure of the lottery machine, into which are inserted balls, each having a means of identification.

This shuffling device comprises a rotating part 5, 6 whose surface 5A, 6A facing the inside of the enclosure carries slender projecting elements 7 such as substantially radial bars 7, intended to hit the balls 1.

According to one characteristic of the invention, this shuffling device comprises:

at least two concentric rotating parts 5, 6, each equipped with slender projecting elements 7, and means 8, 9 for driving said rotating parts 5, 6 at speeds that differ in terms of value and/or direction.

These rotating parts comprise a central disk 6 and a ring-shaped part 5.

Figure 4:
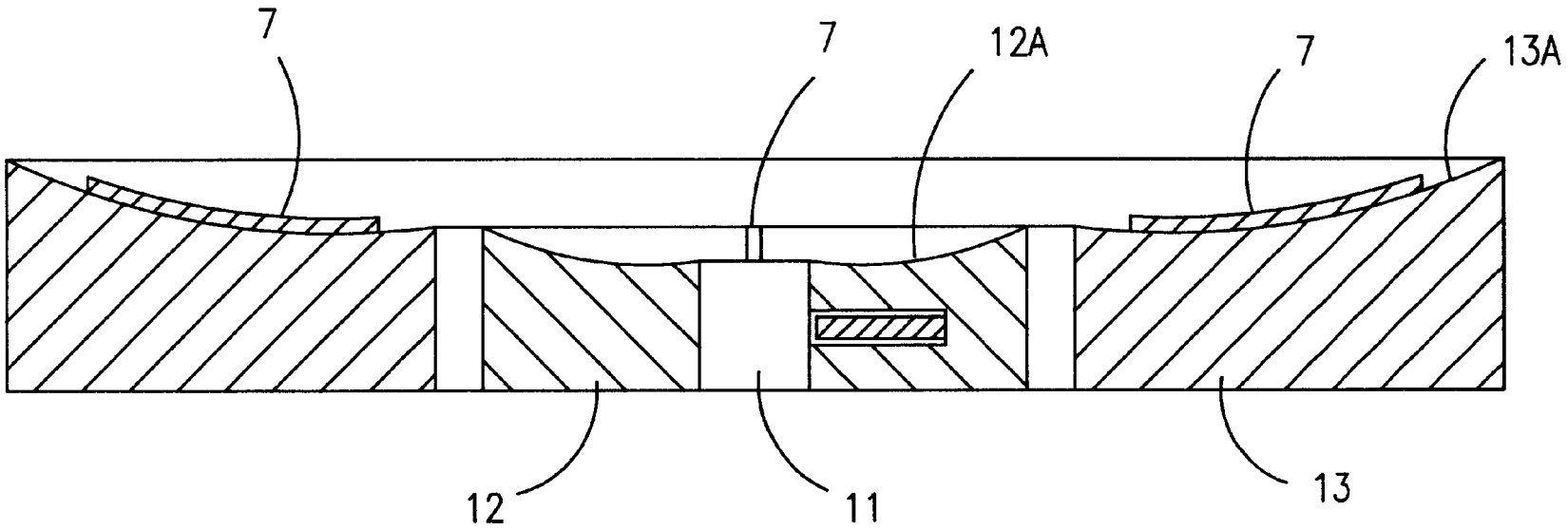
FIG. 4 is a vertical section of a device according to an alternative preferred embodiment of the invention.

In a variant of that embodiment, as seen in FIG. 4, there are two concentric ring-shaped parts 12, 13, the central ring-shaped part 12 having a cutout 11 that makes it possible to extract the ball, for example by connecting it to an exit tube for withdrawing at least one ball or a trap door that allows it to be extracted by gravity.

The driving means preferably drive the rotating parts in opposite directions.

Instead of having the surfaces 5A, 6A, 12A, 13A of the rotating parts be flat, these so-called inner surfaces are concave (FIG. 4, 12A, 13A) or convex (FIG. 1, 5A, 6A) depending on whether the extraction of the balls takes place at the center of the shuffling device or on the outside of it, concavity making it possible to lead the balls toward this exit and hence toward the center of the shuffling device.

The central part 5, 12 has, for example, three angularly distributed bars, while the ring-shaped part 6, 10 comprises a greater number of them, for example eight, in such a way that there is never any coincidence between all the bars of the central part and those of the ring-shaped part.

The rotating parts are advantageously made of transparent material.

What is claimed is:

1. A device for shuffling objects such as lottery balls, disposed at the base of a generally spherical enclosure of a lottery machine, into which are inserted objects, each having a means of identification, said shuffling device comprising:

a first and a second rotating part (5, 6) each of said first and said second parts having an inner surface (5A, 6A) facing an inside of the enclosure, each of said surfaces carrying a plurality of substantially radial slender projecting elements (7) intended to hit said objects (1), said first and second parts further being concentric rotating parts (5, 6), each equipped with slender projecting elements (7), wherein said first part surrounds and rotates around said second part, and wherein said first and said second parts together form a substantially contiguous surface for supporting said objects, and means (8, 9) for driving said rotating parts (5, 6) at speeds that differ in terms of value and/or direction.

2. The device for shuffling objects according to claim 1, wherein the first and second rotating parts comprise a central disk (5) and a ring-shaped part (6), respectively.

3. The device for shuffling objects according to claim 1, wherein the first and second parts comprise two concentric ring-shaped parts, and wherein the central ring-shaped part has a cutout therein.

4. The device for shuffling objects according to claim 1, wherein the driving means is operable to drive the rotating parts in opposite directions.

5. The device for shuffling objects according to claim 1, wherein the surfaces (5A, 6A) of the first and second rotating parts are concave.

6. The device for shuffling objects according to claim 1, wherein the surfaces (5A, 6A) of the first and second rotating parts are convex.

7. The device for shuffling objects according to claim 1, wherein said first rotating part is a centrally disposed part having three angularly distributed bars as its projecting element, and wherein the second rotating part is a ring-shaped part having more than three bars thereon as its projecting elements.

8. The device for shuffling objects according to claim 1 wherein the first and second rotating parts are made of transparent material.

9. A drawing machine comprising:

a generally spherical enclosure;

a device for shuffling objects therein disposed at a base of said spherical enclosure; and a plurality of objects disposed within said spherical enclosure; wherein said device for shuffling objects further comprises a first and a second rotating part, each of said first and second rotating parts having an inner surface facing an inside of said enclosure, said inner surfaces of said first and second parts being positioned such that said inner surfaces form a substantially contiguous surface, and wherein said first part rotates around a perimeter of said second part, each of said inner surfaces carrying a plurality of substantially radially extending slender projecting elements thereon, and means for driving said first and second parts at speeds that differ in terms of value and/or direction.

* * * * *